United States Patent [19]

Christol

[11] Patent Number: 4,974,795

[45] Date of Patent: Dec. 4, 1990

[54] LANDING, PARKING AND TAKE-OFF INSTALLATION FOR HELICOPTERS AND OTHER VERTICAL TAKE-OFF AIR VEHICLES

[76] Inventor: Gérard L. Christol, 144, Ave du Général Leclerc, Sceaux F-92330, France

[21] Appl. No.: 430,083

[22] Filed: Oct. 30, 1989

Related U.S. Application Data

[63] Continuation of Ser. No. 753,551, filed as PCT FR84/00114 on Apr. 20, 1984, published as WO84/04347 on Nov. 8, 1984, abandoned.

[30] Foreign Application Priority Data

Apr. 26, 1983 [FR] France ..... 83 06823

[51] Int. Cl.[5] ..... B64F 1/00

[52] U.S. Cl. ..... 244/114 R

[58] Field of Search ..... 244/114 R, 110 E, 115, 244/116; 52/234, 236.1, 236.3, 300, 174, 173 R

[56] References Cited

U.S. PATENT DOCUMENTS

| | | | |
|---|---|---|---|
| 2,481,343 | 9/1949 | Redstone | 244/114 R |
| 3,033,499 | 5/1962 | Ash | 244/114 R |
| 3,885,368 | 5/1975 | King et al. | 52/79 |
| 3,915,319 | 10/1975 | Fairburn | 244/114 R |
| 4,325,317 | 4/1982 | Wilford | 114/261 |

FOREIGN PATENT DOCUMENTS

| | | | |
|---|---|---|---|
| 911969 | 10/1972 | Canada . | |
| 315761 | 11/1919 | Fed. Rep. of Germany . | |
| 469554 | 7/1937 | United Kingdom | 244/114 R |
| 506737 | 5/1939 | United Kingdom | 244/114 R |

OTHER PUBLICATIONS

"Science and Invention", *Air Transportation Station of 1950,* p. 796, Jan. 1926.

*Primary Examiner*—Galen Barefoot

*Attorney, Agent, or Firm*—Amster, Rothstein & Ebenstein

[57] ABSTRACT

A landing, parking and take-off installation for helicopters and other air vehicles requiring similar conditions comprises two or more interconnected horizontally spaced sets of at least two vertically superposed platforms each. Each set has an exposed landing platform on top, at least one parking/take-off platform therebelow, and a freight elevator functionally interconnecting the platforms and capable of holding a helicopter or other air vehicle, whereby the installation may receive a variable number of helicopters or other air vehicles while occupying only a small area at ground level.

5 Claims, 1 Drawing Sheet

FIG.1
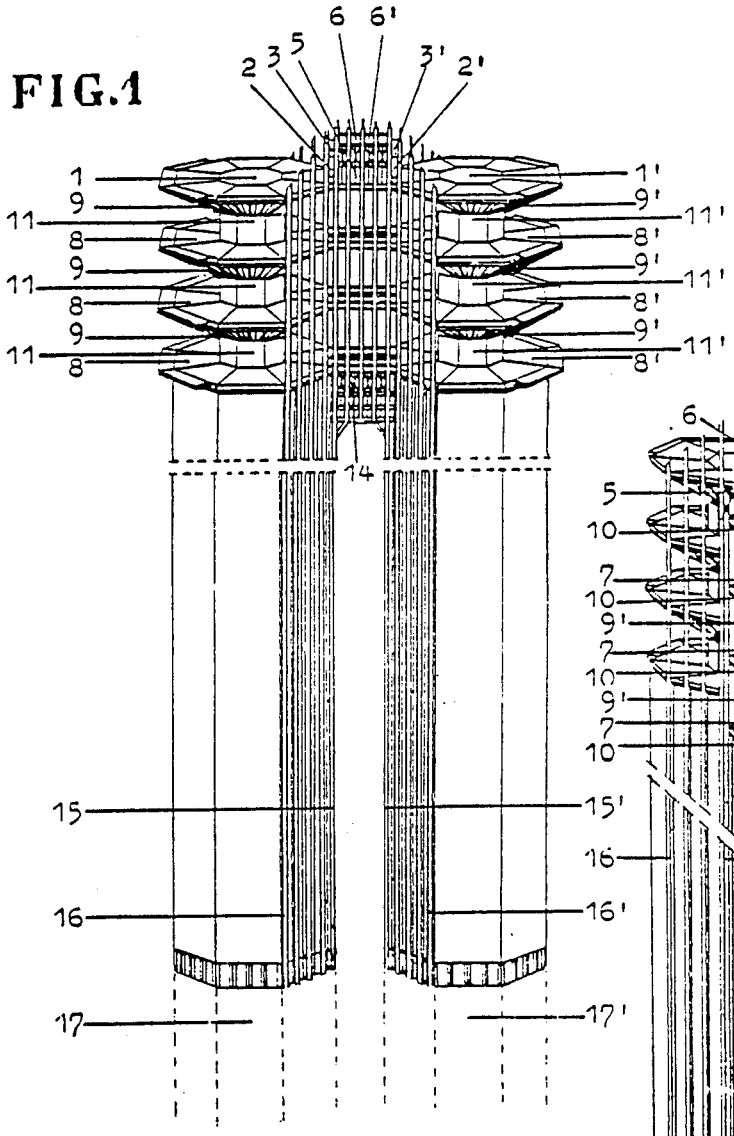
FIG.2
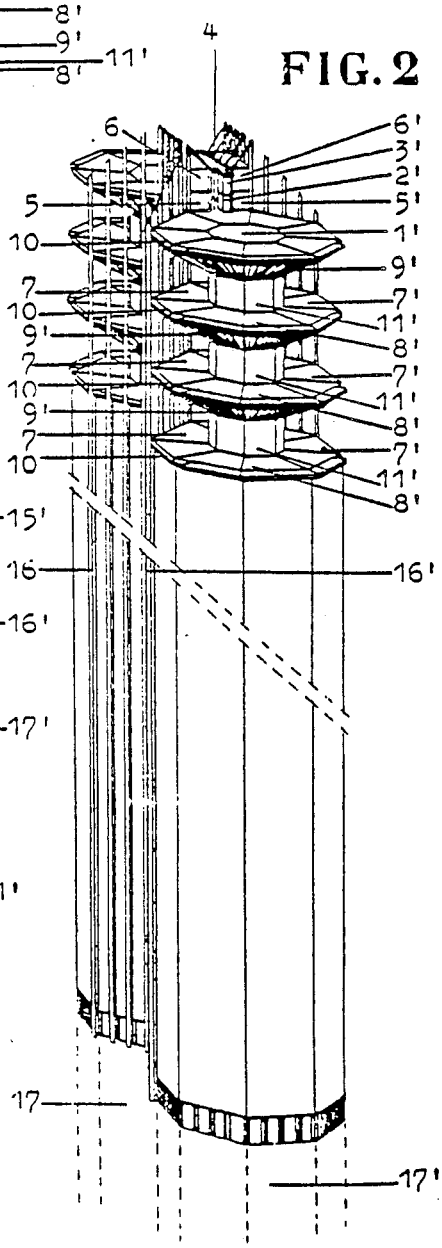
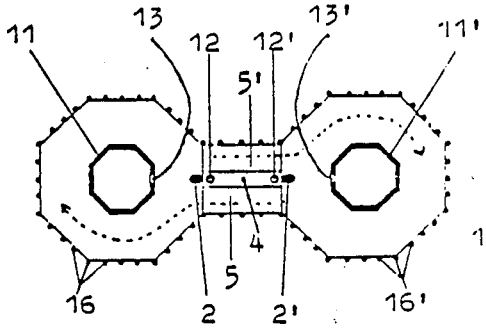
FIG.3

LANDING, PARKING AND TAKE-OFF INSTALLATION FOR HELICOPTERS AND OTHER VERTICAL TAKE-OFF AIR VEHICLES

This is a continuation of co-pending application Ser. No. 753,551 filed as PCT FR84/00114 or Apr. 20, 1984, published as WO84/04347 or Nov. 8, 1984, now abandoned.

The invention concerns a landing, parking, and take-off installation for helicopters and other air vehicles requiring similar conditions. It is characterized by its very large capacity while taking up very little space at ground level.

In particular, the invention is designed to produce an installation in which access to the parking area, for helicopters and other air vehicles requiring similar conditions, is possible without using unnecessarily vast maneuvring and towing areas.

To this end, the installation set forth in the invention is equipped with two large autonomous and juxtaposed freight elevators capable of moving vertically the length of an infrastructure which connects several juxtaposed and superimposed platforms. The latter could be erected from ground level or above ground level. While each one of these platforms is a parking and take-off area, for one or several helicopters or other air vehicles requiring similar conditions, the last two platforms on top are used only as landing areas for these vehicles.

A unique characteristic of the invention lies in the fact that all landing, occuring on one of the two top platforms, is systematically done in the opposite direction from one of the parking platforms underneath. The parking platforms are served by one of the large freight elevators where helicopters go once their propeller blades have been either manually or automatically folded in. It should be noted that this installation, where landing systematically takes place on the platform opposite the one in which the vehicle will be parked, has the important advantage of allowing simple and direct access for manual rolling or towage by a small tractor to take the vehicles to their parking area. In the case of helicopters, they would initially have their propeller blades folded in, then once in the take-off area, their propeller blades would be folded out again.

The variation of building the installation underground presents this invention's other advantages which will appear in the final description of this landing, parking, and take-off installation for helicopters and other air vehicles requiring similar conditions set forth in the invention.

This description is only given as an example and does not limit the invention. The reference notations correspond to appended diagrams.

FIG. 1 is a front view from above in which the dotted lines indicate that the height of the landing, parking, and take-off installation for helicopters and other air vehicles requiring similar conditions is not limited by the invention.

FIG. 2 is a profile view in which the dotted lines indicate that the height of the landing, parking and take-off installation for helicopters and other air vehicles requiring similar conditions is not limited by the invention.

FIG. 3 is an aerial view of two platforms connected by the two large freight elevators and a small pedestrian bridge. These two platforms can be situated at any level but always under the two landing platforms on top of the installation set forth in the invention.

FIG. 2 represents, in a general manner by reference (2'), one of the installation's two small autonomous freight elevators with its machinery on top of it. The machinery is represented in a general manner by reference (3'). These two, small, symmetrically arranged freight elevators, as FIG. 1 represents in a general manner by references (2) and (2'), are each designed for the conveyance of a container whose full capacity could be a load of as much as approximately one ton of fuel for helicopters and other air vehicles.

In fact, in the event that a helicopter or other air vehicle, after landing on one of the two top platforms represented in FIG. 1 by the general references (1) and (1'), would not take-off again soon after and due to this would need to use the parking areas on one of the lower platforms, which are represented in FIG. 2 by references (7) and (7'), it must be considered an absolute necessity for safety reasons, to siphon the gastanks of helicopters and other air vehicles, into a container. This container is then towed by a small tractor to one of the two small freight elevators, one of which is represented in a general manner in FIG. 2 by reference (2').

Then, the container is taken down by one of the two small semi-internal freight elevators the length of one of the installation's two walls which are opposite each other. These are represented in FIG. 1 by references (15) and (15'). When this container reaches the underground level it is stored there, making it a storage place for fuel restocking, represented in FIGS. 1 and 2 in a general manner by references (17) and (17').

It is only after this operation of putting the fuel in the container that the helicopter, once its propeller blades have been manually or automatically folded in, is towed to one of the two large freight elevators which are represented in FIG. 2 in a general manner by references (5) and (5') with their respective machinery located above them. The machinery is represented in FIGS. 1 and 2 in a general manner by references (6) and (6'). So it is one of these two large freight elevators which will take the helicopter, or any other air vehicle down in the direction opposite that of the platform where the landing took place, on one of the parking area platforms located underneath represented in FIG. 2 by references (7) and (7').

In FIG. 1 the elevator cavity infrastructure which houses the machinery of the two large freight elevators is represented in a general manner by reference (14).

On the landing platform, represented in FIG. 1 by references (1) and (1'), passengers may, as soon as the helicopters and other air vehicles are stationary after landing, go to the opening which gives onto the small pedestrian bridge represented in FIG. 2 by reference (4) and then by taking this small pedestrian bridge, which is connected to the one under it by one of the two descending spiral staircases represented in FIG. 3 in a general manner by references (12) and (12'), pedestrians can go to one of the two central cores which support the installation, represented in FIG. 3 by references (11) and (11'). There is a door in each of the central support cores, represented in FIG. 3 by references (13) and (13'). These doors make access to the pedestrian elevators on the inside of each of the installation's support cores possible, giving pedestrians immediate access to all the levels of the installation set forth in the invention.

Each platform is supported by a peripheral structure, represented in FIGS. 1 and 2 by references (9) and (9'), surrounding a central support core represented in FIGS. 1 and 2 by references (11) and (11').

The internal volume determined by the peripheral structures represented in FIG. 1 by references (9) and (9'), depending on the number of interior walls put up within this volume, could be used for various functional habitable needs.

This installation presents from the exit of the two large freight elevators, represented in FIG. 3 by references (5) and (5'), the parking platforms' circular principle around a central core (11) and (11'), permitting maneuvring, either manual rolling or towage by a small tractor, taking the helicopters with propeller blades folded in, to their parking area as represented in FIG. 2 by references (7) and (7').

The take-off area required for rolling in order to get the helicopters in position and to fold out their propeller blades is represented in FIGS. 1 and 2 by references (8) and (8') for each superimposed platform.

The take-off area, represented in FIG. 2 in a general manner by references (8'), is wider and larger than the parking area as represented in FIG. 2 by references (7) and (7').

The parking areas represented in FIG. 2 by references (7) and (7'), offer an additional parking surface for a helicopter, with propeller blades folded in making possible easy access for time consuming maintenance and repair-work which could be done around vehicles as well as over them because of the margin of free space provided by the inclination of the peripheral structure, the latter is represented in FIGS. 1 and 2 in a general manner by references (9) and (9'). The peripheral structure supports the upper platform. The operations required for maintenance or repair-work on the lower portion of the vehicle are made easy because the trapdoors which make up the parking area floor are recessed, represented in FIG. 2 in a general manner by references (7) and (7'). These parking areas are located over the roofing of the peripheral structure, represented in FIG. 2 in a general manner by reference (9'). This means that the service engineer uses the hollow represented in FIG. 2 in a general manner by reference (10). This hollow, then, lies between the roofing of the peripheral support structure, represented in FIG. 2 by reference (9') and the floor which is the parking area, represented in FIG. 2 in a general manner by references (7) and (7'). This peripheral hollow, surrounding the two central support cores represented in FIG. 1 by references (11) and (11'), serves another purpose in that it cuts down considerably on the noise and vibration which occur during the towage maneuvring for take-off.

The invention of this installation also makes it possible to use the take-off platforms, represented in FIGS. 1 and 2 in a general manner by references (8) and (8'), which remain available even if, due to repair-work, a vehicle must stay quite a long time in one of the two parking areas represented in FIG. 2 by reference (7) thus leaving the towing and parking surface represented in FIG. 2 by reference (7'), available for another vehicle to take flight from the take-off area, the latter represented in FIG. 2 in a general manner by reference (8').

In the event that the installation is built entirely underground only the last two platforms on the top of the installation are integrated with the ground and are used for landing but also for take-off as one or the other of these two surfaces represented in FIGS. 1 and 2 in a general manner by references (1) and (1'), alternates in function.

Because of this, none of the underground platforms could be used as take-off areas, as we have previously described, in this case they become an installation exclusively for parking and maintenance in which helicopters, with propeller blades folded in for rolling maneuvres, use the same circular principle around a central support core, the latter represented in FIG. 3 by references (11) and (11'). All the underground platforms can be used to the full depth of the installation because of the two large freight elevators, represented in FIGS. 2 and 3 by references (5) and (5'), which serve all the juxtaposed and superimposed platforms, one going to the desired underground level for parking, the helicopter with propeller blades folded in and other air vehicles alternately, the other receiving these vehicles to bring them back up to the surface to one of the two take-off platforms on top of the installation, the latter represented in FIG. 1 by references (1) and (1').

If the installation is an underground design, as we have just described it, the peripheral structures around a central core, which support the platforms, represented in FIG. 1 by references (9) and (9'), are replaced by a peripheral structure which is on the outside of the installation. This external peripheral structure is partially represented in FIGS. 1 and 2 by references (16) and (16'). Therefore, this external structure constructed around the complete circumference of the installation, as represented in FIG. 3 by references (16) and (16'), ensures, in the event that the installation is built underground, the external vertical support of the circular platforms around the central support cores, the latter represented in FIG. 3 by references (11) and (11').

If the installation is erected above the ground or immediately on top of the ground with an external peripheral structure, represented in part in FIGS. 1 and 2 by references (16) and (16'), only the last two platforms on top are also used alternately for landing and take-off, these are represented in FIGS. 1 and 2 by references (1) and (1'). In this case, as we have previously described for an underground installation, the lower platforms with their complete circumference supported by an external peripheral structure, represented in FIG. 3 by references (16) and (16'), are reserved exclusively for the parking of helicopters and other air vehicles requiring similar conditions.

From the description just given of the installation, whether it be underground, immediately on top of the ground, or above the ground, it is clear that in all three cases the installation can, in addition to its multiple functions as an installation for landing, parking and take-off, accommodate a large number of helicopters and other air vehicles requiring similar conditions while taking up very little space at ground level as set forth in the invention. It is also clear that if the installation is built immediately on top of the ground or above the ground it offers in these two cases, on the inside of the peripheral structures which support the platforms and around the two central supporting cores, space for various functional habitable needs and added to this in an integrated manner in said installation, the functions of landing on, parking in, and taking off from the installation set forth in the invention.

Clearly, the installation can undergo modifications especially with respect to the constitution and number of elements involved in its construction without exceeding the bounds of the invention.

This invention can be used: as an installation in cities' business districts thus allowing direct access from airports—as an installation above the ground used to relieve the traffic congestion of urban highway systems and other traditional modes of transportation—as a large capacity above ground, on top of the ground or underground heliport installation, with, in all three cases, the advantage of occupying a small area at ground level—as a prestigious installation within the framework of an international exhibition or Olympic Games or other temporary events or permanent needs—as an installation integrating various public services: fire prevention, air monitoring, urban police, maritime police, medical emergencies, various offices, housing for public and para public services personnel and others, etc—as an installation integrating community services: meeting point for conferences or tele-audio-meetings—as an installation for stocks of various equipment and materials and exchanges of foodstuffs and various products associated with extra-community exchanges transported by helicopters or other air vehicles—as an installation integrating leisure activities such as: hotels, restaurants, cultural activities, various forms of entertainment, etc—as an installation integrating dwellings connected to an infrastructure of tertiary and secondary activities in areas which are badly or not at all served by highway systems—as an installation adapted to individualized means of air transport which is also at the disposal of the community, or of small squadrons of helicopter-taxis, air-taxis, leaving the ground free while at the same time cutting down on surface congestion and on the up-keep of millions of traffic signs as well as a very large number of bridges and tunnels and other related traditional obstacles—as an exclusively underground installation protecting inhabitants and diverse goods from extreme cold, sandstorms or even from blasts caused by explosions of various bombs with radio-active or bacteriological fallout; all of this becoming operational due to extra-community connections via the air which are provided by the association of hermetic, pressurized helico-taxis and air-taxis with washable exteriors, on ground level, between each trip from installation to installation like so many intercomplementary communication links of different necessary services throughout an entire territory—as an installation superimposed on supporting bases above expanses of water to establish communication while freeing cities or urban areas which are too dense and located next to large bodies of water—as an installation superimposed on supporting bases above sea level for off-shore oil camps or other types of exploitation or production, aquaculture, etc—as an installation superimposed on large supporting bases above forests, the savanna and other natural spaces, thus making the protection of the environment possible, owing to the small ground level area it occupies—as an installation superimposed on small supporting bases keeping the inhabitants and various goods in said installation safe from floods or from bodies of water in certain areas of the world—as widely used installations throughout a whole country or continent interested in freeing the ground to safeguard large surfaces for agriculture, animal stock-farming, natural ecological reserves and the exploitation of natural solar, water, wind and bio-mass energy as could be expected in the case of a radical solution for a new arrangement of habitable space in the developing countries or even in industrialized countries interested in multiplying this installation as set forth in the invention.

I claim:

1. A landing, parking and take-off installation for helicopters and other vertical take-off air vehicles, comprising two or more interconnected horizontally spaced sets of at least two vertically superposed platforms each, each set having an exposed landing platform on top exclusively for landing of vertical take-off air vehicles, at least one take-off platform therebelow exclusively for take-off or take-off and parking of vertical take-off air vehicles, and a freight elevator for each set functionally interconnecting said platforms of a given set and capable of holding a vertical take-off air vehicle, whereby the landing and take-off occur on vertically spaced levels so that they may occur simultaneously within a given vertical plane and said installation may simultaneously accommodate for both landing and take-off a greater number of vertical take-off air vehicles than for either landing or take-off alone; each of said sets having a central support core and an individual peripheral structure extending from and around said central support core to support those of said landing platform and take-off platforms constructed above the ground; thereby to enable landings and take-offs to occur in substantially any direction.

2. The installation of claim 1, wherein some of said peripheral structures define, with the platforms supported thereby, usable internal volumes.

3. The installation of claim 1, wherein at least one of said platforms is defined by a double floor defining a usable internal volume.

4. The installation of claim 1, wherein said platforms are devoid of any vertical walls extending between vertically adjacent platforms, other than said central support core, thereby to reduce a chimney phenomenon in the event of a fire.

5. The installation of claim 4, wherein at least one of said platforms is defined by a double floor defining a usable internal volume.

* * * * *